US005287600A

United States Patent [19]

Wespi

[11] Patent Number: 5,287,600

[45] Date of Patent: Feb. 22, 1994

[54] METHOD AND A DEVICE FOR CONTROLLING AN OPENING PROCESS, FOR EXAMPLE AT A CARD

[75] Inventor: Walter Wespi, Sursee, Switzerland

[73] Assignee: Maschinenfabrik Rieter AG, Winterthur, Switzerland

[21] Appl. No.: 834,560

[22] PCT Filed: Jun. 10, 1991

[86] PCT No.: PCT/CH91/00130

§ 371 Date: Mar. 4, 1992

§ 102(e) Date: Mar. 4, 1992

[87] PCT Pub. No.: WO90/14644

PCT Pub. Date: Nov. 29, 1990

[30] Foreign Application Priority Data

Jun. 12, 1990 [CH] Switzerland ..... 4018803

[51] Int. Cl.[5] ..... D01G 23/06; D01G 9/16

[52] U.S. Cl. ..... 19/300; 19/105

[58] Field of Search ..... 19/80 R, 97.5, 105, 19/98, 239, 300

[56] References Cited

U.S. PATENT DOCUMENTS

| | | | |
|---|---|---|---|
| 4,438,548 | 3/1984 | Grunder | 19/300 X |
| 4,574,433 | 3/1986 | Brunnschweiler | 19/300 X |
| 4,709,451 | 12/1987 | Leifeld | 19/105 |
| 4,860,406 | 8/1989 | Stäheli et al. | 19/105 |
| 4,864,693 | 9/1989 | Pinto et al. | 19/300 X |
| 4,939,815 | 7/1990 | Leifeld | 19/105 |
| 4,955,266 | 9/1990 | Stäheli | 19/105 |
| 5,052,080 | 10/1991 | Gründler | 19/105 X |
| 5,152,033 | 10/1992 | White | 19/105 |

FOREIGN PATENT DOCUMENTS

| | | |
|---|---|---|
| 54648/90 | 11/1990 | Australia . |
| 347715 | 12/1989 | European Pat. Off. . |
| 399315 | 11/1990 | European Pat. Off. . |
| 446883 | 9/1991 | European Pat. Off. . |
| 3821238 | 12/1989 | Fed. Rep. of Germany . |
| 3913996 | 8/1990 | Fed. Rep. of Germany . |
| 2588282 | 4/1987 | France . |
| 956146 | 4/1964 | United Kingdom . |
| 2182956 | 5/1987 | United Kingdom . |
| WO79/00983 | 11/1979 | World Int. Prop. O. . |

OTHER PUBLICATIONS

*Melliand Textilberichte*, Feb. 1973, pp. 107 through 115, by Dr.-Ing. Peter Artzt and Ing. (grad.) Oswald Schreiber.

*Melliand Textilberichte*, Sep. 1973, pp. 885 through 888, by Dr.-Ing. Peter Artzt and Ing. (grad.) Oswald Schreiber.

*Melliand Textilberichte*, Apr. 1974, pp. 317 through 323, by Dr.-Ing. Peter Artzt and Ing. (grad.) Oswald Schreiber.

*Primary Examiner*—Clifford D. Crowder
*Assistant Examiner*—John J. Calvert
*Attorney, Agent, or Firm*—Sandler, Greenblum and Bernstein

[57] ABSTRACT

A method of controlling the opening of a fiber feed at an opening machine like a cleaning machine or a card, in which an opening element is moved past a fiber feed for loosening and taking over of fibers; simultaneously attenuating the fiber feed; determining an output signal corresponding to the opening degree of the fiber feed; comparing the output signal with a reference or set signal for adjusting at least one opening parameter selected from a group consisting of three variables; operating the opening machine following the adjustment; checking the adjustment with a subsequent output signal after adjustment in order to provide further adjustment in the same sense or further adjustment in the contrary sense or no further adjustment of the selected parameters. A device for carrying out this method is also set forth.

19 Claims, 6 Drawing Sheets

METHOD AND A DEVICE FOR CONTROLLING AN OPENING PROCESS, FOR EXAMPLE AT A CARD

Figure 1:
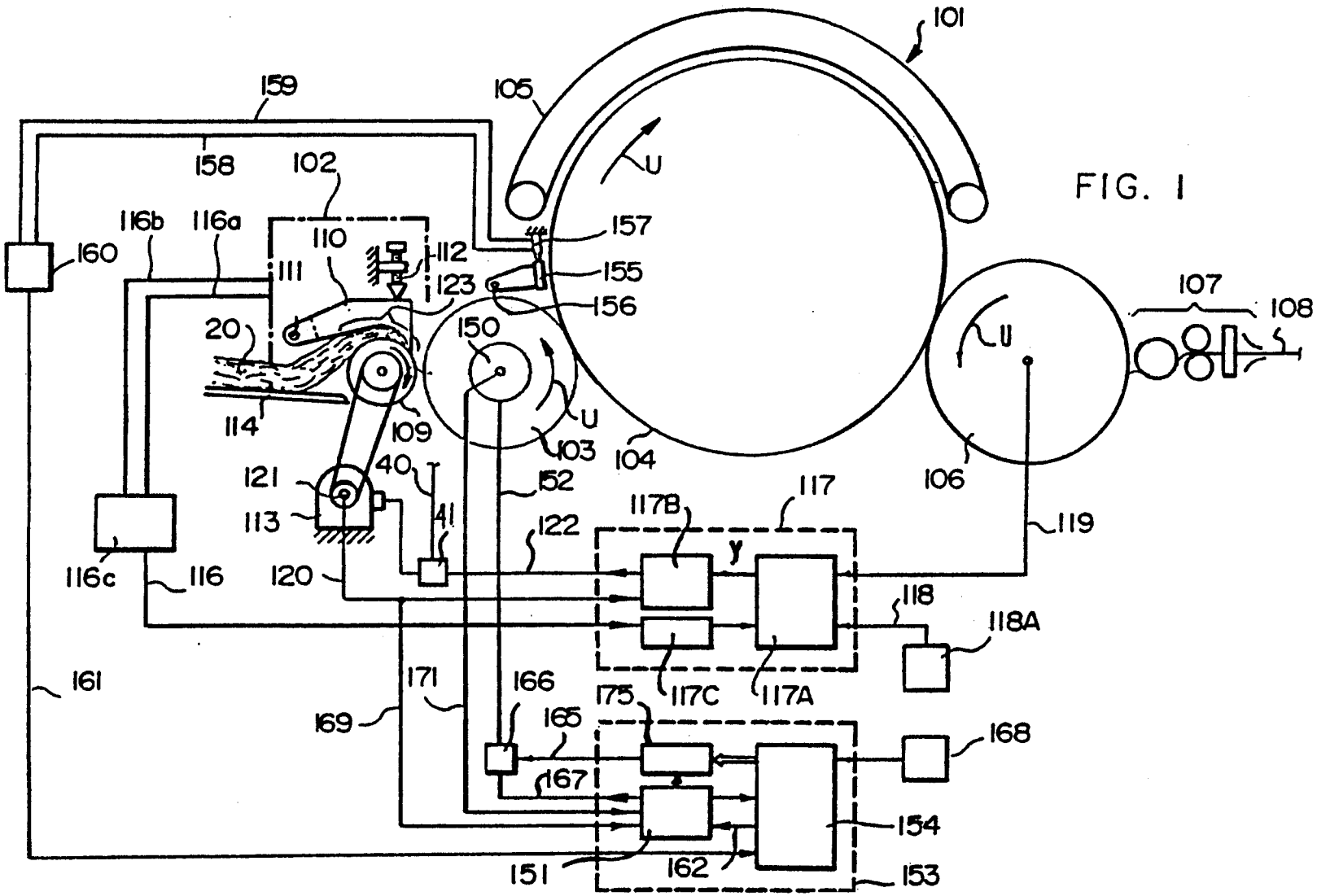

The present invention relates to a method as well as a device for controlling an opening process, for example at a card or cleaning machine, in which an opening element is moved past a fiber feed and fibers are loosened and transferred and which simultaneously attenuates the fiber feed.

Even though, the method in accordance with the invention or the device in accordance with the invention is advantageously applied at a card, the method or the device is not exclusively employed with a card, the method or device being able to be employed in general for controlling the drive of the opening elements, e.g. also at a cleaning cylinder of a cleaning machine.

Many controls and regulations have been proposed contemporarily which enable the rotating speed of the opening elements to be approached at or controlled according to certain predetermined values, furthermore, to enable an adjustment to other parameters.

It is the object to reach a predetermined quality of the product at a highest-possible production rate in order for the end product, i.e. the finished yarn, also to reach a desired quality and furthermore not to disturb the various other steps in the course of the yarn production, for example, with frequent thread breakage.

The quality criteria with, e.g. a card, which are of importance here are low nep number in the card sliver little or no staple damage and little residual dirt content of the fibers.

Although there are attempts to create methods or devices to directly measure the nep number, staple length and residual dirt content during the operation of the card, this has not yet been successfully done to a sufficient degree, the corresponding parameters having to be determined in laboratory tests, at least in the foreseeable future. For this reason such parameters cannot be used directly, i.e. on line, for the control of the production process. Based on collected experience we know today the desirable basic adjustments of the parameters of the yarn producing machine for each fiber mixture.

Even if these basic adjustments for the various parameters are known and it is also known how these parameters must be mutually adjusted during run-up and stopping of the machine or installation, there still remains a very big margin for optimizing the mutual adjustments of speeds in order to increase the quality of the product, even when no production increase is aimed at, e.g. because a critical part of the installation is already set at the upper limit of its output.

Research has already been done in order to determine the so-called card force at high-production cards, probably aiming at developing optimum forms for the spiked clothings or determining optimum adjustments for opening the fiber feed into single fibers.

There is, for example, a report in Melliand Textilberichten February 1973, pp. 107–115, by Dr. Ing. Peter Artzt and Ing. grad. Osswald Schreiber about investigation on the conditions in the area of the taker-in. The authors noticed that the fiber is subject to high stress in the region between the feed trough and the taker-in and can be transported to the swift in a torn or in a flocculated form, i.e. with staple reductions or with insufficient previous opening.

The authors determined the moment at the taker-in caused by the opening of the supplied fiber as measure for the fiber stress.

In practice it was proven that the measurement of the moment at the taker-in is extremely difficult, because the forces to be measured are very little in relation to the massive construction of the taker-in, which is also expressed in the report.

In a later report (Melliand Textilberichte September 1973, pp. 885–888) the same authors report on a photographic method for determining the fiber coating of the swift in order to determine the quality of the previous opening and hence the dependence of the feed and the taker-in speed at high production cards.

These measurements can have their justifications, and can be suitable for the performance of trial courses, but they are not suited for the direct control of, e.g., the operational speed of the taker-in.

Another work done by the two authors is described in Melliand Textilberichten April 1974, pp. 317–323. Here they deal among other things with investigation done on the opening force in the area between the swift and the revolving flat for which a measuring plate was used which was mounted on two bending rods at the frame of a flat rod. Wire stress gauges were fixed to the measuring plate. It showed that because of the circular path of the revolving flat over the flat bend at the card the own-weight influence of the measuring plate on the deformation of the bending rods was a multiple of that of the actual measured value caused by the card force. In order to avoid this problem a second passive force gauge was fixed which has to have possibly the same elastic and geometric properties as the active gauge. The only difference was that the passive gauge was not provided with a clothing. The weight difference was equalized at the strength of the measuring plate. The passive gauge was mounted on the same flat rod and in the same manner as the active gauge, it taking the same position and at its wire strain gauge full bridge of its wire stress gauge the same detuning takes place due to deformation of the bending rods by means of the own weight component.

With an operation amplifier it is possible to compensate the measurement signals in such a way that tension is created which is proportional to the card force.

In summary, the authors found out that the force of the card in the zone swift-revolving flat represents a direct measure for the mechanical stress of the fibers in this zone. They further found out that a bad previous opening leads to a high mechanical stress of the fiber.

The object of the present invention is to create a device or a method of the previously mentioned kind, the device or method enabling a continuous surveillance of the opening process and adjusting it in such a manner that the quality of the product and therefore also the yarn produced in this process continuously represents an optimum at the chosen production speed or each production speed being at a maximum without having to accept quality reductions.

The invention provides the solution of this object in accordance with the method in that the opening degree is determined during the opening process and an output signal corresponding to the opening degree is fed into the control, the control conducting the adjustment of at least one of the parameters influencing the opening, e.g., one of the following parameters:

a. the relative speed of the opening element past the fiber feed, b. the mutual distance of the opening element and the fiber feed, and c. the position (angle and/or length) of the needles of a set, and that it checks based on the output signal whether the adjustment has led to an increased opening and decides, based on the result of this test, for a further adjustment in the same sense or for an adjustment in the contrary sense or for no further adjustment, however, advantageously considering set upper limits for all possible adjustments.

As an upper limit of the maximum relative speed of the opening element past the fiber feed a value is advantageously given into the control at which fiber damage or faults do not appear or appear only within a tolerable extent in the subsequent yarn production.

Advantageously, the opening degree itself is determined by means of a measurement unit which determines the opening degree of the fibers carried by the corresponding element in cooperation with the opening element itself or with a subsequent opening or transport element. Advantageously, this measurement unit is determined by a stationary comb segment cooperating with the corresponding element, which grips into the fibers carried by the corresponding segment, the force acting on the comb segment or a value proportional to it is used as representative signal for the opening degree.

The invention is characterized in accordance with the device by a control circuit regulating the relative speed of the opening element past the fiber feed, by a unit measuring the opening degree of the fiber carried by the corresponding element in cooperation with the opening element itself or with a subsequent opening or transport element, whose output signal is supplied to a memory provided in the control circuit, by an installation effecting an increase of the relative speed in the control circuit, by an installation comparing the historical value stored in the memory or the historical values stored in the memory of the output signal before the increase with the output signal after the increase and by an installation considering the outcome of the comparison and influencing the relative speed.

Advantageously, such a device is characterized by a memory allocated to the control circuit for the upper limit of the maximum relative speed at which faults or yarn damage do not appear or appear only within a tolerable extent.

The present invention departs first of all from the idea that also with installations where certain parts already are operating at their output limit a quality increase of the product can be achieved under certain conditions without having to throttle production. Further there are other areas where, because of fears of reduced quality, production speed has been set uncorrespondingly low; even though, possibly at higher speeds, and hence at higher production, increased quality could be achieved.

Departing from these ideas the invention further recognizes that with a suitable measurement unit, chiefly in form of a stationary comb segment, information concerning the opening degree of the fibers coming from a certain opening element can be derived if the force exerted by the fibers upon this comb segment is measured. With improved opening this force diminishes so that it can be investigated whether an increase of the relative speed of the opening element leads to a reduced force at the comb segment and from this being possible to conclude that the increase of the speeds did lead to a quality improvement. Unfortunately, this method cannot be applied without restrictions, because eventually a condition is reached at which the increased speed of the opening element leads to staple shortage by way of which the force measured at the comb segment also diminishes, from which one could erroneously conclude that the conducted increase of the speed has been advantageous; even though, this has indeed not been the case.

In order to avoid this in accordance with the invention the upper limits of the speeds of the various opening elements with certain fiber mixtures or types are determined, but then it is tried to determine an optimum speed below this upper limit at which the measured force is at a minimum, i.e. the opening degree represents a maximum.

The advantages possible with this invention can be clearly seen e.g. at a card.

The material throughput at a card is after all determined by the rotational speed of the feed roller at the entry of the card, because the entire material running through the feed roller must eventually appear at the output of the card as carded sliver (without the material eliminated due to cleaning of the product). The sliver count is then determined by the so-called draft, which is determined by the ratio of the peripheral speed of the doffing roller to the peripheral speed of the feed roller. However, between the feed roller and the doffing roller the taker-in and the swift are located. The speed of the swift must be adjusted relatively precisely to the peripheral speed of the doffing roller in order not to impair the transfer of the card web from the swift to the doffing roller, but it is possible to variate the rotating speed of the taker-in within wide margins. Determining which rotating speed of the taker-in leads to optimum quality was difficult to do in the past. With the invention the rotating speed of the taker-in is automatically set at an optimum, the optimum speed having to be below the upper limit, however, having to adopt the highest possible value in the area up to this upper limit. If in this manner it is achieved to produce the desired quality, it can be considered if operation should be done with a higher feed roller speed and hence also with increased production and by performing this change it can further be investigated if by controlling the taker-in speed an optimum quality can be reached by increased production as well. Based on this example it is clear that production of the card stays constant with a measuring or optimization row so that a complication of the method caused by a change of the measured force does not take place due to increased production (kg/hr). Of importance is also that it is not absolutely necessary to measure the opening degree directly at the opening element itself. Based on the above described example it is seen that the measurement takes place advantageously at the swift (e.g. due to reasons of space) instead of at the taker-in itself; even though, the latter would also be possible.

The quality of the card sliver can be determined however not only with the rotating speed of the taker-in. The carding work can e.g. be influenced in the area of the revolving flat by the peripheral speed of the revolving flat. Instead of measuring the opening degree at the revolving flat itself, it is proceeded in accordance with the invention that a comb segment which is stationary in operation is arranged after the revolving flat in order to determine the opening degree effected by the carding work in the area of the revolving flat. Here too according to the invention the opening degree is not determined at the opening element itself but at a subsequent element.

During application of the invention at a cleaning machine it can be determined by means of a comb segment applied for measuring the opening degree, if with a higher rotating speed of the cleaning roller an increased production can be achieved without quality loss.

Extremely advantageous variants of the method or device in accordance with the invention can be gathered from the depending claims.

It should be emphasized that there is a number of variable parameters which can influence the quality of the product. For example, the following changeable measures are adjustable at a card with the present invention:

- opening degree at the taker-in and the swift,
- swift speed in relation to output (output is given by the batt weight and by the infeed speed at the feed roller),
- rotating speed in relation to the swift speed,
- swift speed in relation to the raw material (type of raw material and length of the staple as well as impurity content),
- taker-in speed in relation to raw material,
- taker-in speed in relation to swift speed,
- adjustment of the working elements, e.g. clothing distance between taker-in and swift, swift and revolving flat and swift and doffing cylinder.

All such measures include at a certain card with predetermined clothings a change of a relative speed or of a relative distance, or a change of a fiber mixture, and all these changeable parameters can be measured on line with the present invention.

Figure 2:
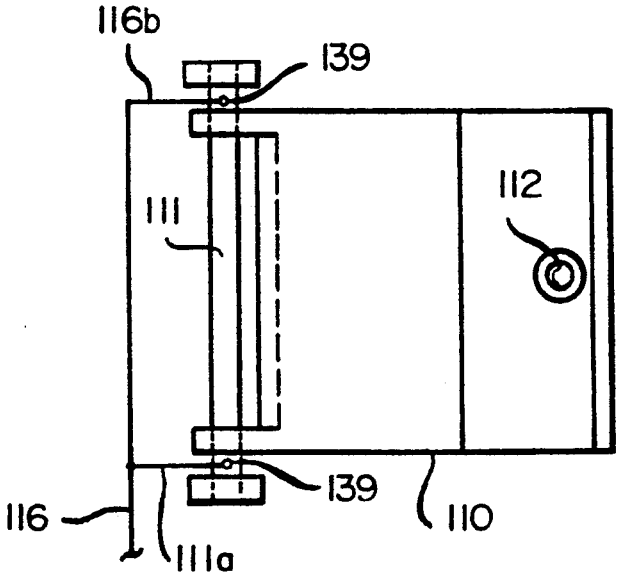
Figure 3:
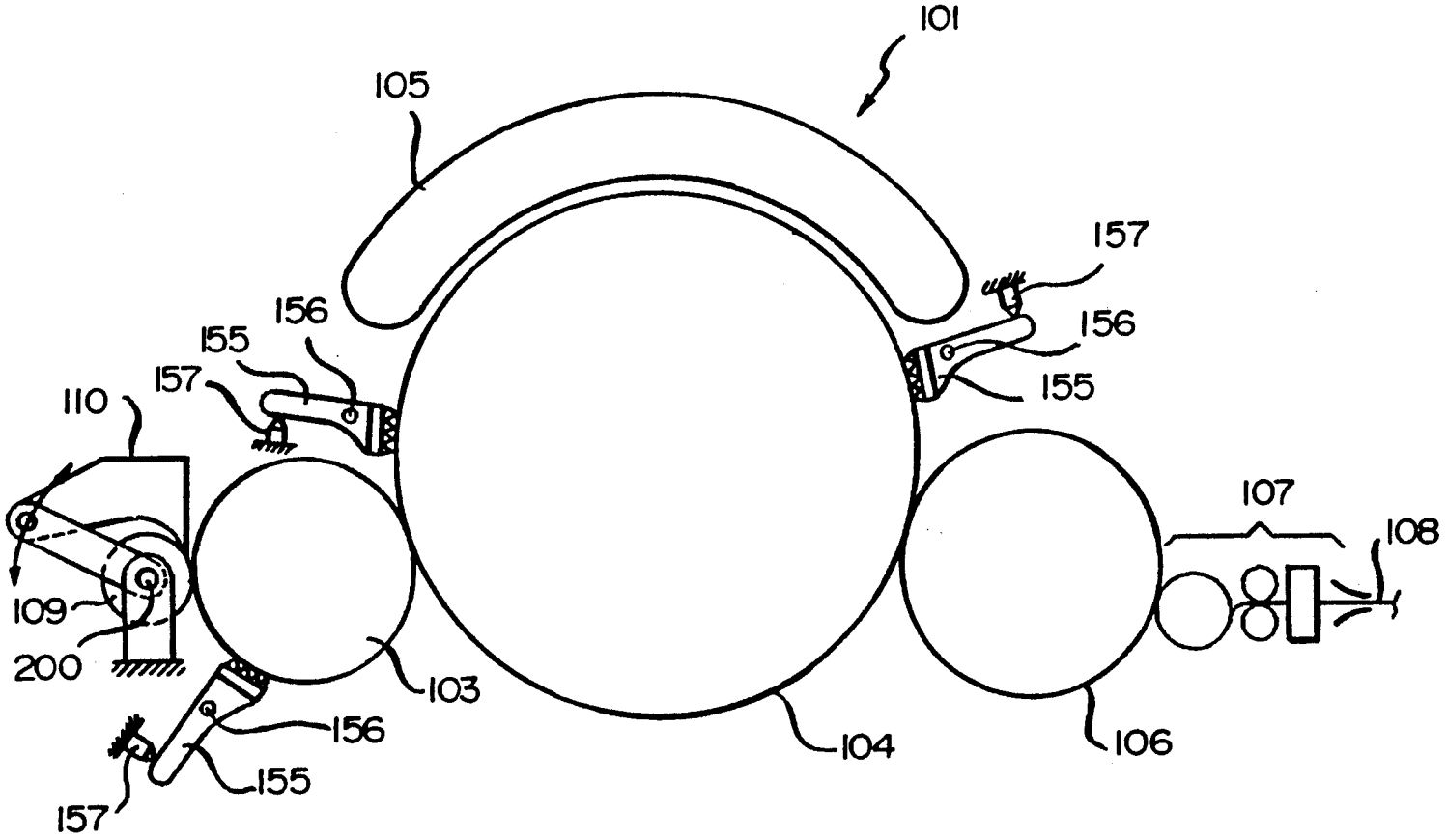
Figure 4:
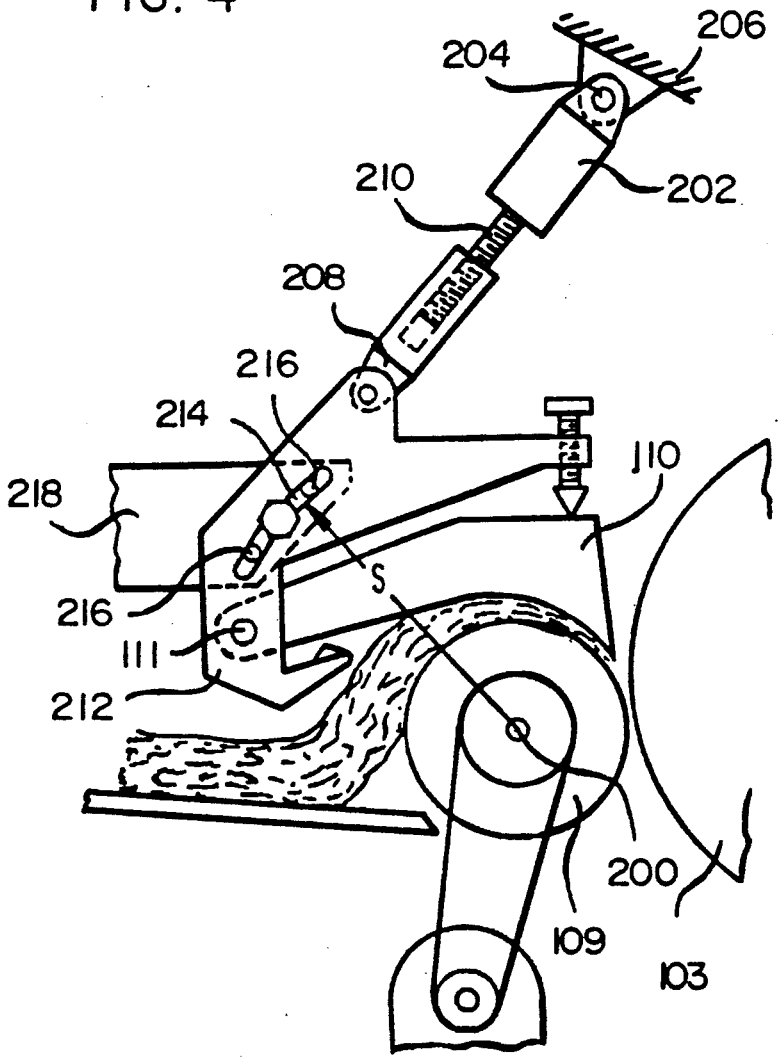
Figure 5:
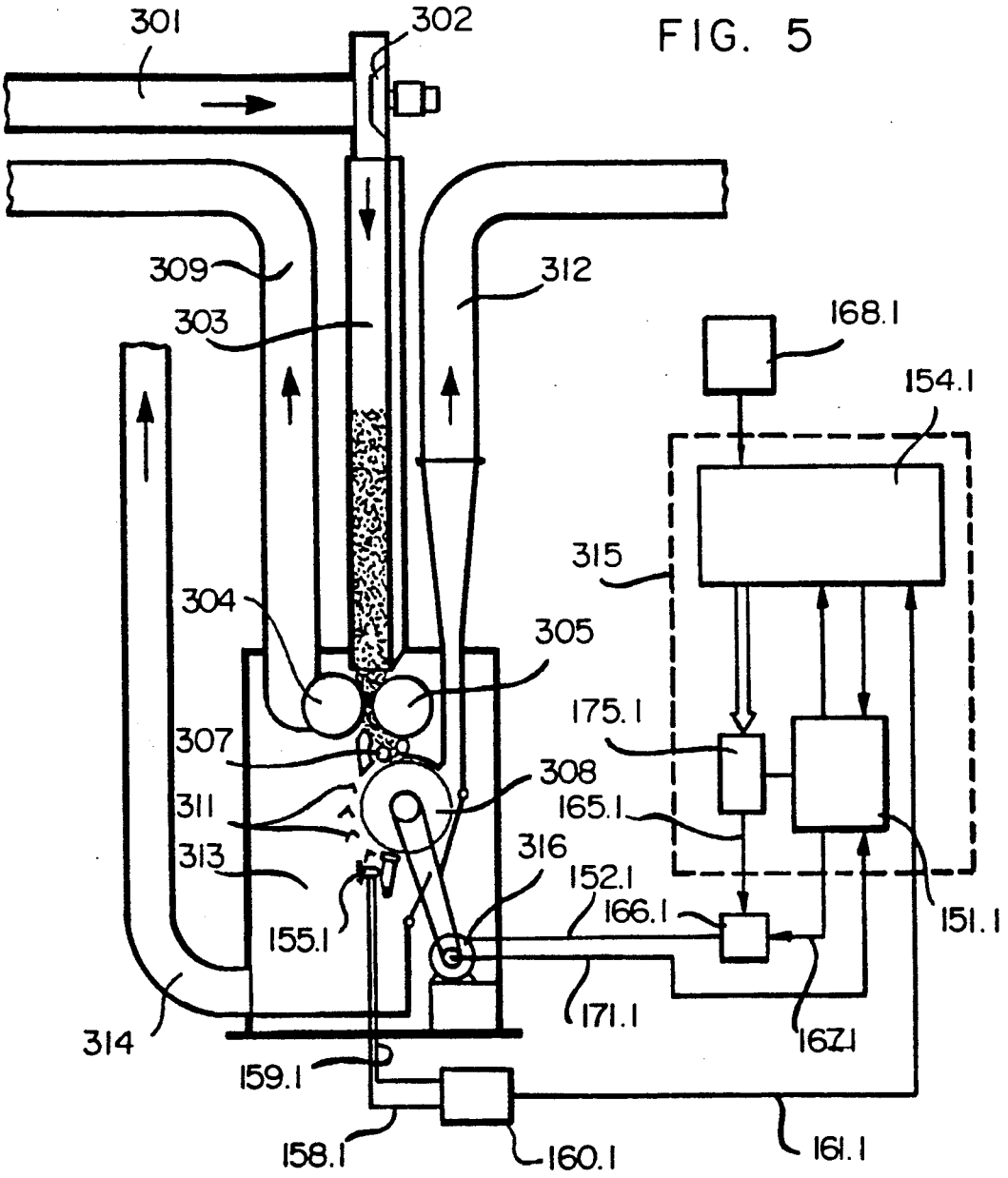
Figure 6:
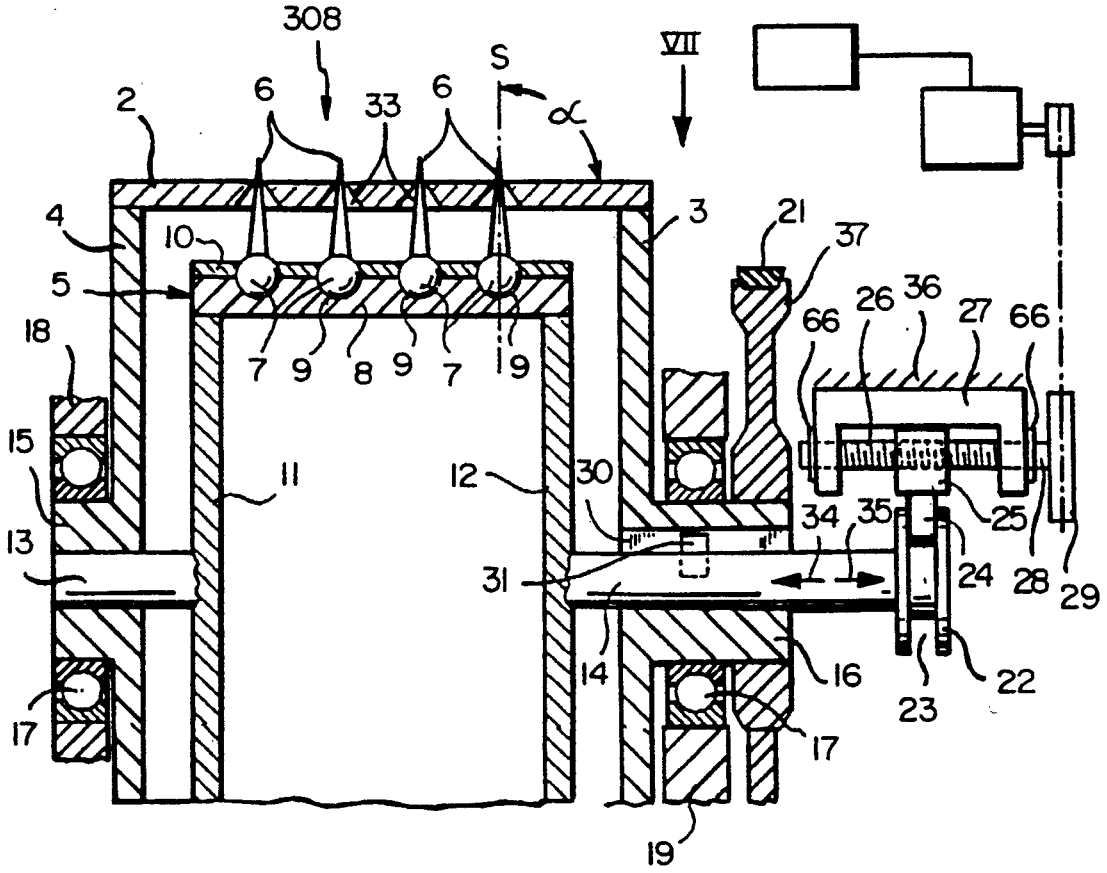
Figure 7:
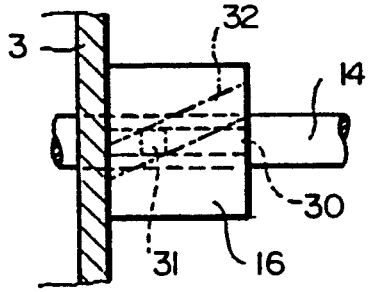

The invention will now be explained based on the embodiments with reference to the illustrations, in which, FIG. 1 is a schematic sideview of a controlled card, FIG. 2 is a detail of the measurement unit of the card according to FIG.1, FIG. 3 is a schematic sideview of a controlled card similar to the card of FIG. 1, however, with the trough plate being adjustable around the rotating axis of the feed roller, FIG. 4 is a detailed illustration of the adjustment unit of the trough plate of the embodiment according to FIG. 3, FIG. 5 is a schematic sideview of a cleaning machine with a control in accordance with the invention, FIG. 6 is a cross section of an opening roller of a cleaning machine, represented in part and semi-schematically, FIG. 7 represents a part of the opening roller of FIG. 6 in viewing direction VII of FIG. 6.

The controlled card 101 represented in FIG. 1 comprises, seen from left to right, at the card entry a fiber infeed means 102 represented in dash-dotted line, a taker-in roller 103, a swift 104 with a flat 105, a card web doffing cylinder 106, and a card web compression unit 107 for forming the card sliver 108. The fiber infeed means 102 comprises a rotating and driveable feed roller 109, also called feed cylinder, and cooperating with it a feed plate 110, also called trough plate, which is pivoted around a swivel pin 111.

The feed roller 109 is arranged stationary and the swivelability of the feed plate 110 is limited by a check screw 112 in the movement direction away from the feed roller 109 as well as by a stop in the opposite direction. The feed roller 109 is driven by a gear motor 113.

During operation the fiber wadding 20 is guided to the fiber infeed means 102 on a feeder plate 114. Due to the rotation of the feed roller 109 in peripheral direction U, the fiber wadding is fed in a known manner to the much faster rotating taker-in cylinder.

The taker-in cylinder loosens single fibers from the fiber mat and transports them on its surface consisting of a spiked clothing, to the swift 104. The transfer of the loosened fibers from the taker-in cylinder to the swift takes place in the region where the two elements are close to each other. The fiber web formed in this manner on the swift is then transported to the revolving flat 105.

The fiber web processed between the swift 104 and the flat 105 is then removed by the doffing cylinder 106 and passed on to the fiber web compression unit 107 in which the fiber web is compressed to the card sliver 108.

The ratio of the peripheral speed of the doffing cylinder 106 to the peripheral speed of the feed roller 109 yields the so-called draft ratio of the card.

Further, by introducing the fiber wadding 20, the feed plate 110 is swiveled away so far from the feed roller 109 until the feed plate is stopped by the check screw 112. This position of the feed plate 110 is called the operating position. With help of this check screw 112 the measure of the compression of the fiber wadding 20 between the feed plate and the feed roller 109 is adjusted. This clamping effect causes measurable values, which will subsequently be described, in the fiber infeed means 102 by means of which a signal 116 can be obtained continuously corresponding to the density of the "clamped in" fiber wadding 20.

In order to obtain the signal 116, as shown in FIG. 2, two signals **116*a*, 116*b* from the wire strain gauge 139 fixed to the left and the right of the swivel axis 111 of the feed plate 110 are used which meter the lateral force of the axle journal of the feed trough. These signals 116*a*, 116*b* are fed to a test amplifier 116*c* which firstly adds the signals and then amplifies it, producing the signal 116 which represents an amplified mean value signal. The test amplifier 116*c*** transforms the signals of the wire strain gauge receiver into a DC voltage which lies between $-10$ and $+10$ volts.

The signal 116 is given into a control 117 together with a set value signal 118 for the batt thickness, a speed signal 119 of the doffing roller 106 and a speed signal 120 of the shaft 121 of the gear motor 113, the set value signal 118 and the speed signal 119 of the doffing roller 106 having a predetermined value. The value of the set value signal 118 can be chosen at a decade switch 118A and eventually determines the desired sliver count.

The control "processes" the above mentioned signals into an output signal 122 which is fed to a multiplier 41. The multiplier 41 receives a signal via line 40 which undertakes a correction of the control based on the existing absolute humidity of the air, as described in the German patent application No. 38 21 238. The multiplier 41 therefore multiplies the output signal 122 with the signal received via line 40, the output signal 122 being corrected according to the absolute air humidity (German patent application No. 38 21 238). The output signal of the multiplier 41 determines the speed of the gear motor 113 according to the deviations in the density of the fiber wadding 20 in the clamping area 123 in such a way that the density of the fiber wadding upon leaving the clamping area is essentially even or uniform. By way of the interference quantity compensation effected by the multiplier 41 the control of the density of the fiber wadding 20 is already corrected to consider variations in the absolute air humidity so that the card sliver 108 and the fiber band produced from it finally have the desired sliver count, without being influenced by the absolute air humidity.

The control 117 essentially consists of a microcomputer 117A of the Texas Instr. Company, type 990/100MA with the necessary number of EPROMs type TMS2716, also by Texas Instruments, for programming control functions, as well as of a control unit 117B type DIO AKNRV 419 D-R by the company Areg, West Germany. The control unit 117B amplifies a speed signal sent by the microcomputer into output signal 122 and receives signal 120 for the control and the regulation of the speed of the feed roller.

The input signal 116 is processed at first in a step 117C. The mean value of the input signal is newly computed at regular short time intervals from a fixed number of last reading values. In this manner, if desired, the long-term deviation of the feed can be determined (drift filter). At very short time intervals of approx. 100 ms the instantaneous value of the input signal is compared with the mean value in the step **117*c*, and the deviation is passed on to the microcomputer 117A as actual value. The latter is programmed as PI controller and computes a control value y from the set value of the decades based on the control algorithm preset in the EPROMs and preprogrammed device-specific data which forms the set value for the Areg control 117B and is supplied to it, as is schematically illustrated with the corresponding arrow between block 117A and 117B**.

In this arrangement it is also possible to place the multiplier 41 between the blocks 117A and 117B so that the set value of the Areg control is corrected according to the absolute air humidity.

It is further possible to perform the functions of step 117C in the microcomputer by installing corresponding EPROMs or by corresponding programming, so that a separate step **117*c*** is dispensable.

The Areg control is an independent control electronics installed before control motor 113. The preset set value given off by microcomputer 117A is compared with the tacho actual value 120 in the control electronics, the difference is amplified and supplied to the motor via the output loop. The control electronics 117B functions as voltage dosage and supplies the motor only with the voltage which is required for reaching the required torque and for maintaining the speed.

The card control discussed until now has already been described to this extent in the German patent application No. 38 21 238. Additionally, to the parts described to this point the card includes a quality control which will now be described in detail.

The taker-in 103 in accordance with the invention is driven by a motor 150 which is placed directly on the shaft of the taker-in. This motor is a three phase A.C. motor with a frequency converter which is controllable by a microcomputer 151 via line 152. The microcomputer 151 is part of a control 153 which furthermore consists of a memory 154 and a comparator 175.

Above the taker-in 103 there is a comb segment 155 which is equipped with a spiked clothing, the spiked clothing not being shown, however it can be arranged just like a conventional flat clothing. The comb segment 155 stretches along the entire width of the swift and is in its measurements similar to a conventional stationary flat clothing. As opposed to a conventional flat clothing it is however linked to a rotating axle 156 so that the card force exerted by the swift tries to twist the comb segment 155 counterclockwise around the axis. This is impeded by a mechanical buffer 157, in the actual embodiment two such buffers being provided, one buffer at each end side of the card. Each buffer is also provided with a wire strain gauge so that the force exerted on the buffer can be acquired with the wire strain gauge. The exact arrangement of the wire strain gauges will not be described here, because they are well known from similar arrangements. The signals from the strain gauges of the two buffers are supplied via the corresponding lines 158, 159 to a data amplifier 160 which produces an amplified mean value signal corresponding to the test amplifier **116*c* which is supplied to the control 153 via the line 161. The signals coming via line 161 are picked up at time intervals and temporarily stored in the memory 154. It is tried to keep a relatively low number of stored values in the memory 154** and the old data is deleted after a short time and replaced by new data. This could e.g. be performed by a shift register, for example one with 32 storage locations, with 16 new values being read into this memory per second.

The microprocessor 151 continuously forms the mean value of the stored values, which it extracts via the bus 162 from the memory. The mean value thus formed is fed to the comparator 175. The latter receives also directly from the memory 154 the value of the signal which was the last to be fed via line 161 (or a newer mean value) and forms the ratio of the mean value which arrived last divided by the value which arrived last (or older mean value divided by the newer mean value). The result of this division is then fed to a multiplier 166 via line 165. At the other input of the multiplier 166 a control signal from microprocessor 151 is fed via line 167 which represents the desired speed of the motor 150.

This signal is determined by the computer 151, i.e. based on a table in memory 154 which contains for each fiber type or mixture pre-calculated values of the speed of the taker-in 104 for certain speeds of the feed roller 109. The computer chooses the fitting value from the memory 154 in knowledge of the presently used fiber mixture which is communicated to the control 153 via the keyboard 168 under consideration of the actual speed of the feed roller 109 which is continuously communicated to the computer via line 169. Via line 171 the computer receives also a signal concerning the actual speed of the taker-in 103 or of the motor 150 which drives it directly.

The computer checks the speed signal which is received via line 171 in order to determine whether this signal has reached the upper limit also stored in the memory 154, the upper limits also being stored in the form of a table in memory 154, i.e. according to the speed of the feed roller 109.

The tables of the upper limit values and the tables of the output values for the speed of the taker-in 103 in comparison to the speed of the feed roller 109 can be present in the EPROMs or can be input individually via keyboard 168.

This tabulated form assures that during run-up of the card or stopping of the same the taker-in 103 stays within the desired speed range. The control in accordance with the invention can advantageously be arranged in such a way that it is operated only after the run-up of the card or of the corresponding installation.

It can be seen from the above description that the multiplier 166 multiplies the nominal value of the set speed of the taker-in received via line 167 from the microcomputer 151 with the signal received via line 165 and thereby increases or lowers the set speed signal for the taker-in 103 depending on whether the before determined value of the card force signal is smaller or greater than the shortly before determined mean value. By way of the mean value formation the variations of the card force signal are balanced.

If the computer 151 now determines that the actual speed received via the line 171 corresponds to the basic adjustment of the set speed stored in the memory, the set speed signal is automatically increased by a fraction, e.g. by 1%, in order for the taker-in to get closer to the set upper limit, on the condition that it has not yet been reached. If this increase leads to a decrease of the instantaneous card force in comparison to the mean value up to now, this can be seen as measure that the opening has improved due to the increased speed of the taker-in. A further increase of the speed of the taker-in can be conducted in order to find out whether a further decrease of the card force results. This procedure can be continued until the upper limit is reached. If after an increase of speed the card force increases, which may be due to the taker-in removing big tufts from the fiber wadding instead of loosening single fibers from it, the speed is automatically reduced by the comparator which is collected by the computer via line 171. Based on the extent of the speed change the computer can now decide whether a further change of the speed is suitable and effect it via line 167 if necessary. This way the computer 153 approaches the optimum value. Once this value is determined the control according to the invention can be turned on, and the installation can be driven with this optimum value.

As already mentioned at the beginning, the invention is by no means restricted to speed changes alone. The computer 153 for example can be arranged in such a way that it changes the distance between the taker-in and the swift and also based on the card force measurement by way of the wire stress gauges decides if this change of distance has a positive or a negative effect. The upper limit of the change is to be understood here as the minimum distance between the taker-in and the swift which is necessary to avoid mechanical damage of the clothing.

The invention is of multiple application because one "measure carding element" can be provided after each adjustment possibility within which the opening of the tuft takes place.

FIGS. 3 and 4, for example, show that the trough plate 110 can be dislocated around the rotating axis 200 of the feed roller 109 which results in a varying opening degree of the tuft between the feed roller 109 and the taker-in 103. The subsequent comb segment or the subsequent card flat 155 with load cell 157, which invariably does not have primarily a carding function but a measuring function, i.e. the distance of this card element to the surface of the taker-in must be kept constant, has the function of measuring the opening degree between the feed roller 109 and the taker-in 103. This measurement can also take place in the preliminary carding zone, as this is shown at the example of FIG. 1, as well as in the post carding zone, in each case with a comb segment arranged immediately after the area of the opening, also with a correspondingly preset and fixed distance to the surface of the swift 104.

A possible adjustment installation for the trough plate 110 is shown in FIG. 4. It consists here of a spindle motor 202 which is electrically adjustable, which is coupled at one end 204 to the card frame 206, the free end 208 of the spindle 210 is coupled to an adjustable plate 212 which carries the rotational axis 111 of the trough plate. The plate 212 has a bow-formed slot 214 with radius S the curve center of which is positioned on the rotational axis 200 of the feed roller 109. Within the guide slot two sliders 216 are located which cooperate with the side limit of the guide slot 214 and which ensure that the desired adjustment of the trough plate around the rotational axis of the feed roller 109 takes place. The sliders 216 are mounted on a plate 218 which is firmly arranged opposite of the machine frame 206 of the card. By way of raising or lowering of the spindle motor the plate 212 and hence also the trough plate 110 is dislocated around the rotational axis 200 of the feed roller 109, the arrangement being of such kind that the change of the distance between the trough plate and the rotational axis 200 does not take place.

It is however not absolutely required that the card plate forming the comb segment is always arranged immediately after the surveilled opening element. It is obvious that during an improvement of the opening, e.g. between the feed roller 109 and the taker-in 103, the opening of the fibers improves in the entire carding process so that for the determination on whether the opening between the feed roller 109 and the taker-in 103 has improved, e.g. also a comb segment arranged in the post carding zone can be used. An arrangement in which the comb segment 155 is arranged underneath the taker-in 103 to determine the effect of the adjustment of the trough plate is preferred, the comb segment 155 in the preliminary carding zone determining the effect of the adjustment of the speed of the taker-in and the comb segment 155 in the post carding zone determining the effect of the adjustment of the rotational speed of the transversal flats.

A further possibility is given by adjusting the distance of the taker-in to the swift und to determine the opening degree resulting herefrom by means of a comb segment 155 arranged in the breaker carding zone.

The adjustment between the taker-in and the swift as well as between the flat and the swift has already been described in the European patent 0 015 974 and can also be combined with the distance measurement installation which is described in the German patent application No. 39 13 996.

With all variants an element which influences the opening degree is adjusted in the sense of an aimed improvement of opening, the effect of this adjustment is almost immediately noticeable in the measurement signals of the load cell 157 of the allocated card plates 155, and a computer effects a comparison of this signal and the historical value of the signal in order to determine if the adjustment has led to an improvement of the opening degree. If such an improvement commences, a further adjustment in the same sense is conducted and a new comparison is made. This way the possible upper limit of the adjustment is approached. If however the comparison is negative, which points out a deterioration of opening, the adjustment is cancelled down to the adjustment where the best result has been obtained.

The above discussed idea with various variants can further be expanded in that e.g. a card plate with measuring function always follows a card plate with carding function thus being able to determine the opening degree per card plate.

Extreme caution must be applied when for the changing of the opening degree the speed of an element is changed which is connected with a change of production. It is obvious that when an increase of the speed leads to an increase in production, this will most probably also lead to an increase of the measured card force so that under these circumstances the information of a rising card force has to be handled with care and caution. If necessary, a computer must consider the change of force caused by the speed as correction factor in order to extract the effective opening degree from the measure signals of the comb segment.

A further embodiment of the invention is schematically represented in FIG. 5. The machine represented in FIG. 5 represents a cleaning machine for the cleaning of tufts which are delivered via a line 301 and a feed top with fan 302 into a lamella chute 303. The flock material present in the chute 303 is drawn out at the lower end of the chute 303 by means of a blind drum 304 and a sieve drum 305 and supplied via a feed roller pair 307 to a cleaning roller 308 carrying a needle clothing. During the movement between the blind drum 304 and the sieve drum 305 dust and other light impurities are removed from the flock mass by suction through the sieve drum. The air pressed out of the loose flocks is sucked off via line 309. In the area of the cleaning roller 308, which acts as an opening element, the flocks are opened, i.e. divided into smaller tufts and moved over a knife grate 311, the impurities particles and the dust being loosened from the flocks transported this way. The cleaned flocks are then transported via the transport line 312, e.g. to a further cleaning machine or to a filling box of a card feed. The impurities removed from the flocks falls through a grid into an elimination chamber 313 and is transported away from there via an elimination transport line 314 pneumatically.

Below the cleaning roller there is a comb segment 155.1 which is arranged exactly as the comb segment 155 in the embodiment according to FIG. 1 and hence also characterized with the same reference number, however with the addition 0.1, in order to point out that this is a different machine. This convention is also applied with all other parts of the embodiment according to FIG. 5, given that the parts described in it correspond too the parts of the embodiment according to FIGS. 1 and 2.

A control circuit 315 is provided for the drive of the cleaning roller 308 which also contains in correspondence with the control circuit of the embodiment according to FIG. 1 a computer 151.1, a memory 154.1 and a comparator 175.1. A keyboard 168.1 is provided here as well.

The maximum admissible speed values of the cleaning roller are entered in tabulated form as function of the various fibers and fiber mixtures to be cleaned by the cleaning machine.

In operation the force acting on the comb segment, corresponding to the card force according to the embodiment according to FIG. 1, is acquired via the wire stress gauge receivers provided at both ends of the comb segment. The signals of the wire stress gauge receivers are supplied to the data amplifier 160.1 (FIG. 5) via lines 158.1, 159.1 which supplies an amplified mean value to the memory 154.1 via line 161.1. These values are stored in the memory 154.1 in exactly the same manner as in the memory 154 of the embodiment according to FIG. 1. Here too mean values are continuously formed in the microcomputer 151.1 and are temporarily stored in the memory 154.1. Here too the comparator 175.1 effects a comparison of the value last received via signal line 161.1 and the actual mean value of these signals and the result is supplied to the multiplier 166.1 via line 165.1.

A set speed signal for the cleaning roller which represents, as in the embodiment of FIG. 1, a basic adjustment and lies below the upper limit, is supplied as well to the multiplier 166.1 via line 167.1 where it is multiplied with the signal supplied via line 165.1 and fed to the drive motor 316 as corrected set signal. The actual speed of the drive motor is supplied to the microcomputer 151.1 via line 171.1 and is continuously compared with the value representing the admissible upper limit of the speed of the cleaning roller. The computer effects an increase of the set speed of the cleaning roller after taking into operation of the cleaning machine and then determines according to the described manner in connection with the embodiment according to FIG. 1, based on the signals received via line 171.1, whether the actual speed is higher than the set speed and whether simultaneously the output signal of the comparator 155.1 is responsible for it. In affirmative case the speed signal for the drive motor 316 is increased in order for the rotating speed of the cleaning roller also to be increased.

If the card force, as measured by the comb segment 155.1, should increase already before reaching the upper limit, it can be concluded that the opening by the cleaning roller is deteriorating and the computer can switch the operation speed back to the value where the card force has its minimum.

As can be seen in the above description the computer 151 as well as the computer 151.1 must be programmed in order to conduct the various comparisons. It is also possible to substitute the small microcomputer 151 or 151.1 with a somewhat more efficient microcomputer which also performs the functions of the memory, the comparator, the multiplier and even of the data amplifier. Here it is also possible to let the control 117 of FIG. 1 also be performed by the same microcomputer. In practice, such a solution is more likely to be found; the separation of the various function blocks serves primarily explanatory reasons of the invention but could be performed in terms of software without problems.

The cleaning roller 308 of FIG. 5 could also be of the formation in accordance with European patent application No. 0446 883 of the present assignee, i.e. having a clothing which is changeable during operation in order to change the degree of opening. The clothing could for example comprise needles capable of changing their position, i.e. their angle, and/or effective length. A possibility for a specific formation of such a cleaning roller can be taken from FIGS. 6 and 7. Here an opening roller 308 (FIG. 6) has a roller body 2 which is provided with end walls 3 or 4 which are firmly connected with it. The end wall 3 is provided with a shaft bearing 16 and the end wall 4 with an axle bearing 15. The axle bearing 15 and the shaft bearing 16 are again pivoted by a rolling bearing 17 which is firmly embedded in a machine frame part 18 or 19. This way the opening roller 1 is rotatably journalled in a stationary machine frame.

For the drive of this opening roller a drive wheel 37 is mounted on the shaft bearing 16 which is driven by the driving belt 21.

The axle bearing 15 serves for the rotating reception of an axle 13, and the shaft bearing 16 for the reception of a shaft 14, both being components of a clothing support roller 5. This clothing support roller has a support cylinder 8 which is firmly connected with the end wall 11 and 12, the end wall 11 being firmly connected with the shaft 13 and the end wall 12 being connected in a fixed manner with the shaft 14.

The support cylinder 8 is provided with semi-spherical recesses 9 which serve as receptions of spherical needle bases 7 each having a clothing needle 6. By means of these spherical bases 7 each clothing needle is pivotable in the corresponding semi-spherical bearing recess. In order to keep the needle bases in the recesses 33 these are covered with a cover plate 10, however in such a manner that the pivoting of the clothing needles 6 is maintained.

The clothing needles 6 pierce through the roller body 2 through round holes provided therein (not listed) each being provided with funnel-shaped recesses 33 seen from the direction of the clothing base. These recesses 33 enable the swivelability of the clothing needles in order to change the position of the clothing needles and hence their intensity.

The swiveling of the clothing needles 6 takes place by an axial dislocation of the shaft 14 in the dislocation direction 34 or 35. The axial dislocation of the shaft 14 again takes place by the dislocation of a dislocation element 25 in that a slider block 24 pertaining to the dislocation element 25 reaches into a ring-formed guide groove 23 of a guide wheel 22 connected with the shaft 14 and in this manner dislocates the guide wheel 22 in axial direction.

The dislocation element 25 again is placed on a threaded dislocation shaft 26 which is pivoted in a bearing support 27. Turning of the dislocation shaft 26 takes place at a wheel disc 29 which is connected to a shaft 28 including threaded shaft 26. The dislocation thread 26 is secured by means of forelock discs or circlips 44 against axial dislocation.

The bearing support 27 is firmly allocated to a machine frame part 36.

In order for the clothing roller 5 to turn in unison with the roller body 2 the shaft 14 is equipped with a guide wedge 31 located in an axially directed guide groove 30 which is provided in the shaft bearing 16. The guide groove 30 enables the dislocation of the shaft 14 in the dislocation direction 34 or 35.

By dislocating the shaft 14 and hence the clothing roller 5 in the dislocation direction 34 or 35 the angle $\alpha$ is changed which defines an imaginary symmetric line s of the clothing needle and a coating (not listed) of the periphery of the roller body 2 which crosses the symmetric line.

The said dislocation causes a change of the angle $\alpha$, i.e. it causes that the needle points of the needle clothings 6 define different angles $\alpha$ in relation to the peripheral surface of the roller body 2 by which their intensity towards the tufts to be opened will change.

FIG. 7 represents semi-schematically on the one hand the mentioned guide groove 30 in dash line and on the other a slanted groove 32 in dash-dotted line, in reality however such a slanted groove is spirally arranged so that with a dislocating of the shaft 14 in the direction 34 or 35 simultaneously a rotation of this shaft takes place so that the angle of the clothing needles in peripheral direction of the rollers are also changeable. This angle is on the one hand defined by the said symmetric line s and a peripheral line (not listed) of the roller body pheriphery. By this additional changed direction of the needles 6 the possibility is created to further variate their intensity. The change of the angle includes also a change of the effective length of the needles.

It is obvious that the adjustment possibilities represented in FIGS. 6 and 7 can also be applied for the purposes of the present invention. By changing the adjustment of the needles the comb segment 155.1 of FIG. 5 will determine a changing force which can be applied for the control of the operational position of the needles of the clothing according to the way which has already been described several times.

A further development could be in that the succeeding cleaning machine determines the opening degree of the previous one, provided that this measurement cannot take place already in the actual machine.

I claim:

1. A method of controlling the opening of a fiber feed at an opening machine of one of a cleaning machine and a card, in which an opening element is moved past a fiber feed for loosening and taking over of fibers, simultaneously attenuating the fiber feed, and determining an output signal corresponding to the degree of opening of said fiber feed, comparing said output signal with one of a reference and set signal for adjusting at least one opening parameter selected from the group consisting of:

(a) the relative speed of the opening element past said fiber feed;

(b) the mutual distance of said opening element and said fiber feed;

(c) the position of the needles of a clothing of said opening element;

operating said opening machine following said adjustment;

checking said adjustment with a subsequent output signal after adjustment; and providing further adjustment in a same direction or an adjustment in an opposite direction no adjustment.

2. A method as defined in claim 1, including binding of all possible adjustments by predetermined upper limits.

3. A method as defined in claim 2, including determining a value of the upper limit of the maximum relative speed of the opening element past the fiber feed, at which one of value fiber damage and faults do one of not appear and appear only within a tolerable extent in the subsequent yarn production.

4. A method as defined in claim 1, including determining the degree of opening by means of a measurement at the fibers carried by one of said opening element and by a transport element subsequent to and cooperating with said opening element.

5. A method as defined in claim 4, including determining the degree of opening by one of a stationary comb segment cooperating with said opening element and with said transport element and which grips into the fibers carried by one of said opening element and said transport element, and using the force acting upon one of the comb segment and a value proportional to it as a representative signal for the degree of opening.

6. A device for controlling the opening of a fiber feed at an opening machine of one of a cleaning machine and a card, in which an opening element is moved past said fiber feed for loosening one of small amounts of fibers and single fibers from said fiber feed, comprising a control circuit controlling at least one opening parameter selected from the group consisting of:

(a) the relative speed of the opening element past said fiber feed;

(b) the mutual distance of said opening element and said fiber feed; and (c) the position of the needles of a clothing of said opening element;

a measuring unit for measuring the degree of opening of said fiber feed at one of said opening element and of a transport element subsequent to said opening element, an output signal thereof being supplied to a memory unit within said control circuit;

means, in said control circuit, for causing an adjustment of said selected at least one parameter;

operating means for adjustment of said at least one selected parameter; and means comparing a single historical value or multiple historical values of said output signals stored in said memory unit with a subsequent output signal said after adjustment for checking and signalling said operating means for further adjustment or no adjustment of said selected parameter.

7. A device as defined in claim 6, further including means having a memory for storing the upper limits of the maximum relative speed allocated to the control circuit, at which limits one of fiber damage and faults do one of not appear and appear only to a tolerable extent in the subsequent yarn production.

8. A device as defined in claim 6, wherein said measuring unit is a comb segment, the working tips of said comb segment gripping into the fibers carried by an opposite element and which comprises measurement sensors for the forces acting upon the comb segment.

9. A device as defined in claim 6, wherein said opening machine is a card, said opening element is the taker-in of said card, with said control circuit determining the rotating speed of the taker-in and said measuring unit cooperating with the main cylinder of the card.

10. A device as defined in claim 7, wherein said opening machine is a card, said opening element is the taker-in of said card, with said control circuit determining the rotating speed of the taker-in and said measuring unit cooperating with the main cylinder of the card.

11. A device as defined in claim 8, wherein said opening machine is a card, said opening element is the taker-in of said card, with said control circuit determining the rotating speed of the taker-in and said measurement unit cooperating with the main cylinder of the card.

12. A device as defined in claim 6, wherein said opening machine is a cleaning machine, said opening element is a cylinder equipped with needle clothings, with said measuring unit cooperating directly with said cylinder.

13. A device as defined in claim 7, wherein said opening machine is a cleaning machine, said opening element is a cylinder equipped with needle clothings, with said measuring unit cooperating directly with said cylinder.

14. A device as defined in claim 8, wherein said opening machine is a cleaning machine, said opening element is a cylinder equipped with needle clothings, with said measuring unit cooperating directly with said cylinder.

15. A device as defined in claim 8, wherein said comb segment has several needle clothings which can be brought into contact at random with one of the amount of loosened fibers and with the single fibers.

16. A device as defined in claim 15, wherein said comb segment is arranged in one of a pivotable and rotating manner and carries at least two different needle clothings.

17. A device as defined in claim 6 at an opening machine, of one of a cleaning machine and a card, in which an opening element is moved past said fiber feed and loosens one of small amounts of fibers and single fibers from said fiber feed, wherein means for dislocating a trough plate around the rotating axis of a feed roller is provided and is adjustable for adjusting the degree of opening of said opening element.

18. A device as defined in claim 17, wherein said measuring unit for measuring the degree of opening is a comb segment which cooperates with one of a taker-in and a swift.

19. A device as defined in claim 6, wherein said opening element has a clothing which is changeable during the operation of said device, in particular in that the clothing has needles which are adjustable in their position, for one of angle and length, for the adjustment of the opening effect during the operation of said device.

* * * * *